US005941746A

United States Patent [19]

Isnard et al.

[11] Patent Number: 5,941,746

[45] Date of Patent: Aug. 24, 1999

[54] VESSEL WITH A DISCONNECTABLE RISER SUPPORTING BUOY

[75] Inventors: Jean-Loup Isnard, Vence; Patrick Ducousso, Folian; René Perratone, Menton, all of France

[73] Assignee: Single Buoy Moorings Inc., Marly, Switzerland

[21] Appl. No.: 08/934,851

[22] Filed: Sep. 22, 1997

[30] Foreign Application Priority Data

Sep. 20, 1996 [EP] European Pat. Off. ..... 96202632

[51] Int. Cl.[6] ..... B63B 22/02

[52] U.S. Cl. ..... 441/4; 114/230.12

[58] Field of Search ..... 441/3–5; 114/230, 114/230.12

[56] References Cited

U.S. PATENT DOCUMENTS

| | | | |
|---|---|---|---|
| 3,111,926 | 11/1963 | Shatto . | |
| 3,236,267 | 2/1966 | Bily | 114/230 |
| 3,605,668 | 9/1971 | Morgan | 441/3 |
| 3,799,097 | 3/1974 | Robertson . | |
| 3,905,190 | 9/1975 | Pearlman | 114/230 |
| 4,019,771 | 4/1977 | Perez | 294/66 R |
| 4,033,277 | 7/1977 | Schaper | 114/230 |
| 4,637,335 | 1/1987 | Pollack | 114/230 |
| 5,305,703 | 4/1994 | Korsgaard | 441/4 |

FOREIGN PATENT DOCUMENTS

| | | | |
|---|---|---|---|
| 2160166 | 12/1985 | United Kingdom | 114/293 |
| 2 291 389 | 1/1996 | United Kingdom . | |
| WO 93/24733 | 12/1993 | WIPO . | |

*Primary Examiner*—Sherman Basinger
*Attorney, Agent, or Firm*—Young & Thompson

[57] ABSTRACT

The invention relates to a vessel which is attached to the sea floor by at least one anchor line. A riser support buoy (9) is releasably connected to the vessel. The anchor line or anchor lines are attached to the vessel outside the area of the riser support buoy (9) such that the buoy can be detached from the vessel independently from the attachment of the anchor lines. By releasing the riser support buoy while maintaining the anchor lines in place, the buoy can be released by maintenance purposes, inspection of the buoy body or the riser without the vessel going adrift. Also the forces between the vessel and the buoy are reduced as the anchor lines are not attached to the riser supporting buoy. The riser supporting buoy may be provided with stabilisation lines (45,45') which on one end comprise a ballast weight (46,46').

6 Claims, 3 Drawing Sheets

56
60
61
51
57
59
55
54
58
53
55'
57'
50
52

VESSEL WITH A DISCONNECTABLE RISER SUPPORTING BUOY

The invention relates to a vessel comprising anchor lines for attaching to a sea floor and a riser supporting buoy releasably connected to the vessel, the supporting buoy being connected to a subsea structure via a riser.

In the offshore technology, floating production, storage and offloading vessels, drilling rigs or barges, are often anchored to the sea floor by means of catenary anchor lines, such as anchor chains. From a subsea structure, such as an oil well, flexible risers are attached to the vessel or to the rig, for instance via a turret around which the vessel or rig can weathervane.

From U.S. Pat. No. 4,604,961 a mooring buoy is known which can be releasably attached to a tanker for hydrocarbons. The buoy is attached to the seabed by a number of catenary mooring lines. A flexible riser is connected to the mooring buoy. When the mooring buoy is released from the vessel, the anchor lines are all disconnected at once. No controlled release of the anchor lines is possible.

It is an object of the present invention to provide a vessel which can be disconnected from the riser supporting buoy while the position of the vessel can be maintained. It is a further object of the present invention to provide a vessel wherein forces between the vessel and the buoy, and in particular on riser connections, are reduced. It is another object of the invention to provide a vessel comprising a riser supporting buoy that can be easily inspected or repaired. It is a further object of the invention to provide a vessel which can be disconnected from its anchor lines in a controlled manner.

Thereto the vessel according to the invention is characterised in that the anchor lines are attached to the vessel outside the area of the riser supporting buoy, the buoy being detachable independently from the attachment of the anchor lines.

By being able to release the riser supporting buoy, while maintaining the anchor lines in place, it is possible to release the buoy for maintenance purposes, inspection of the buoy body or the riser, attachment of additional risers to the buoy, etc. without the vessel going adrift.

Furthermore, since the anchor lines are not attached to the buoy, the forces between the vessel and the buoy are reduced, such that the chance of deformation or other damage to the riser connections that are present in the buoy, are reduced.

Also the construction of the coupling mechanism between the buoy and the vessel, can be simplified as the forces between the buoy and the vessel are relatively low compared to the prior art construction known from U.S. Pat. No. 4, 604,961. Furthermore, by attaching the anchor lines to the vessel instead of to the riser supporting buoy, it is possible that the riser supporting buoy forms a water tight seal with the vessel, such that a dry space can be created above the buoy in the vessel allowing easy access to the buoy.

Preferably the anchor lines are detachable for each line independently or in groups. Hereby it is possible to detach the vessel from the sea floor in stages, while the riser supporting buoy remains connected and the flow of hydrocarbons to the vessel is maintained. It is also possible to release the buoy from the vessel and to for instance flush the riser or groups of risers, while the vessel remains attached to the anchor lines.

In this way, the vessel position can be optimised in case of high seas or during storm conditions. A staged release of the anchor lines is also important in case an object, such as an ice berg is observed which may collide with the vessel. At a first distance of the object from the vessel, a number of anchor lines may be disconnected as a precaution. When the object approaches further, the anchor lines are released successively until the vessel is able to move out of the path of the object.

By placing the disconnect means directly on the vessel, instead of at some distance along the anchor lines, no cables will protrude from underneath the vessel after disconnecting. Thereby the risk of interference of the anchor lines with the vessel itself, with other vessels, or with objects on the seabed in shallow waters, is avoided. Furthermore, the disconnect means according to the invention can in this case be directly controlled from the vessel by means of a cable connection, such as by a hydraulic or electrical control signal or by mechanical control. Also can inspection and maintenance be easily performed. This is of particular importance when the vessel is operated in for instance arctic waters.

The term "anchor lines" as used herein is intended to comprise anchor cables, ropes, wires or chains. The term "vessel" as used herein is intended to comprise floating structures, such a tankers, barges, rigs, weathervaning structures, mooring buoys etc.

Preferably, the disconnect means are hingingly attached to the vessel, such that the disconnect means can follow the movement of the vessel with respect to the anchor lines, and the stress on the disconnect means remains low.

In another embodiment of a vessel according to the invention, the support buoy comprises at least one stabilisation line, which on one end could comprise a ballast weight. The stabilisation line is free from the sea floor when the buoy is attached to the vessel and is at least partly located on the sea floor when the buoy is detached from the vessel.

Using a stabilisation line instead of an anchor line will cause the buoy to be submerged to a predetermined depth and remain at this submerged position.

Another embodiment of a vessel according to invention comprises means for placing ballast weight inside the buoy and removing ballast weight therefrom. Hereby the level by which the buoy is submerged after disconnecting can be adjusted. Hereby the level of submerging of the buoy can be adapted to the load of the vessel and the depth of the vessel below the water line.

The vessel according to invention may comprise a turret well extending from deck level to keel level and a rotatable turret placed in the turret well, the riser supporting buoy and the anchor lines being attached to the turret near keel level. A vessel of this type can weathervane around the turret to maintain an optimum position with respect the wind and wave direction.

Embodiments of a vessel according to the invention will be described in detail with reference to the accompanying drawings. In the drawings.

Figure 1:
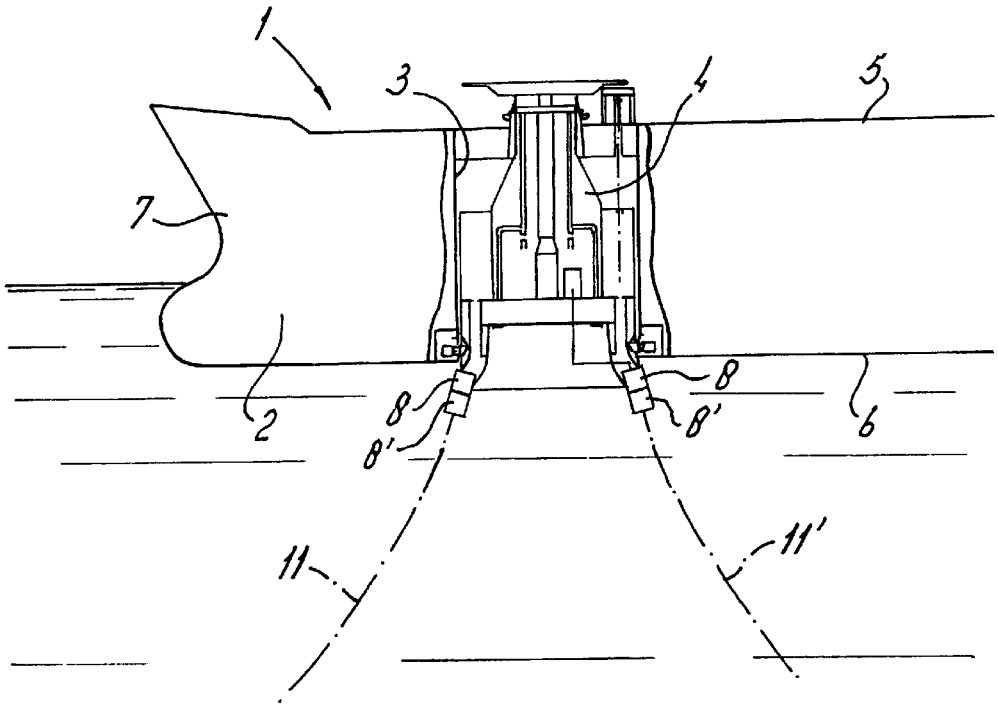
FIG. 1 shows a schematic, partly cross-sectional view of a vessel comprising a detachable riser supporting buoy in a disconnected state.
Figure 1:
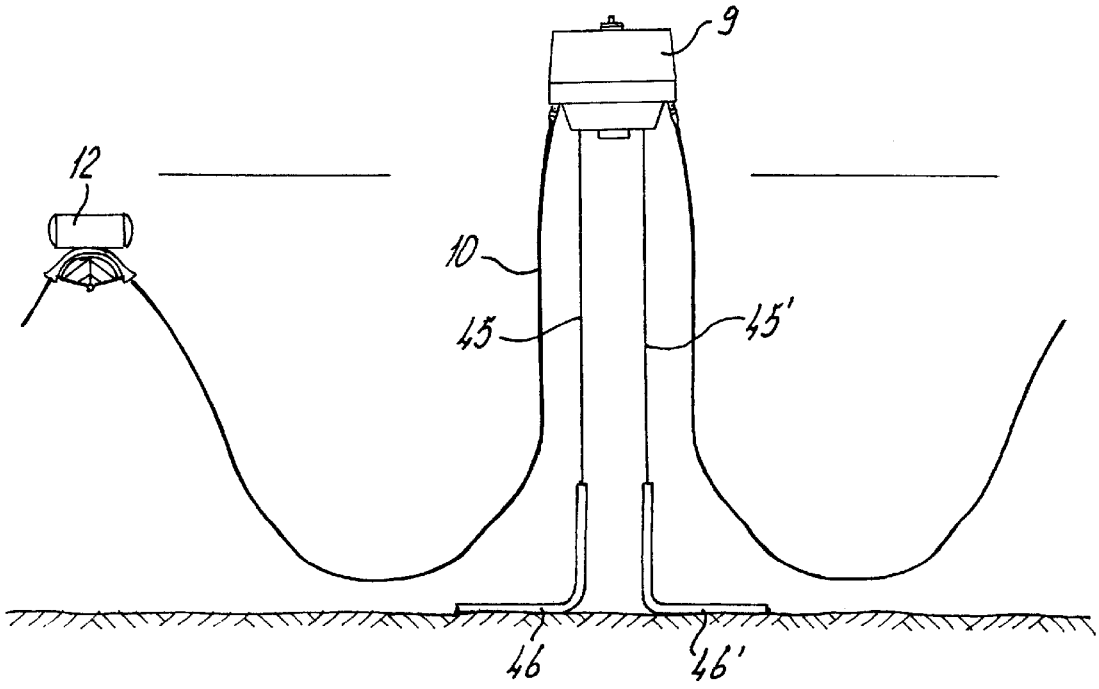

In FIG. 1 a vessel 1 is shown which near its bow 7 is provided with a turret well 3. The turret well 3 is formed by a cylindrical opening in the hull extending from deck level 5 to keel level 6 below the water line. In the turret well 3, a geostationary turret 4 is mounted such that the vessel 1 can weathervane around the turret 4. Flexible risers 10 from an oil well in the sea bed, are supported by submerged buoys 12, and are connected to a riser supporting buoy 9. The riser supporting buoy 9, which in FIG. 1 is shown in the decoupled position, is releasably attached to the lower end of the turret 4. The vessel 1 is anchored to the sea bed by means of anchor lines 11 which comprise at their free ends a second part 8' of a disconnect means which releasably engages with a first part 8 of the disconnect means that is attached to the bottom of the turret 4.

In an embodiment, the riser supporting buoy 9 is connected to stabilisation cables 45,45', such as 1.5" steel cables of a length of 40 m, having at their lower ends ballast weights in the form of chain pieces 46,46' of 641 chain with a length of 15 m. When the buoy 9 is connected to the vessel, the stabilisation cables will be substantially free from the see floor, whereas in the decoupled state of the buoy 9, such as shown in FIG. 1, the ballast chains 46,46' will be located at least partly on the sea floor.

Figure 2:
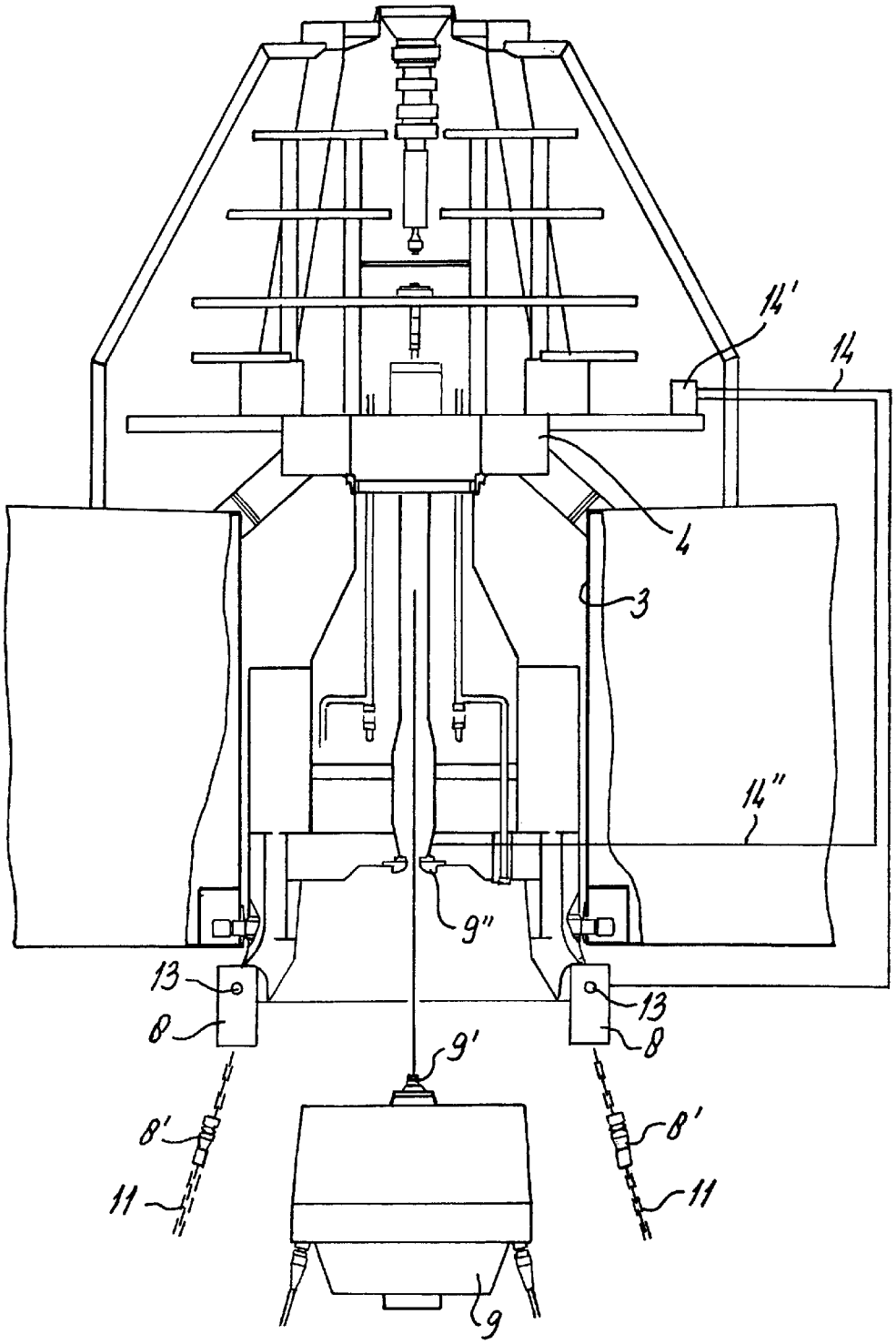
FIG. 2 shows an enlarged detail of the vessel of FIG. 1.

As shown in FIG. 2, the first parts 8 of the disconnect means are hingingly attached to the bottom of the turret 4, in hingepoints 13. The first parts 8 comprise a sleeve in which the plug 8' at the free end of the anchor lines 11 can be inserted. The outer surface of the plug 8' comprises coupling means, such as a number of teeth or projections, which can engage with the teeth or projections on the inner surface of sleeve 8. The projections of the sleeve 8 may be mechanically, hydraulically or electrically movable between an coupling position and a decoupling position. A release control means 14, such as an electrical cable or an hydraulic line, is connected to the sleeve 8 and is on the other side connected to a control unit 14' on the vessel for activating the disconnect means 8,8'. Another cable or hydraulic line 14" can be connected between the control unit 14' and the coupling organs 9" for the buoy 9. The coupling organs 9',9" can be of simple construction, and comprise a number of hook shaped members 9" on the vessel 1 and a notch 9' on the buoy 9.

Figure 3:
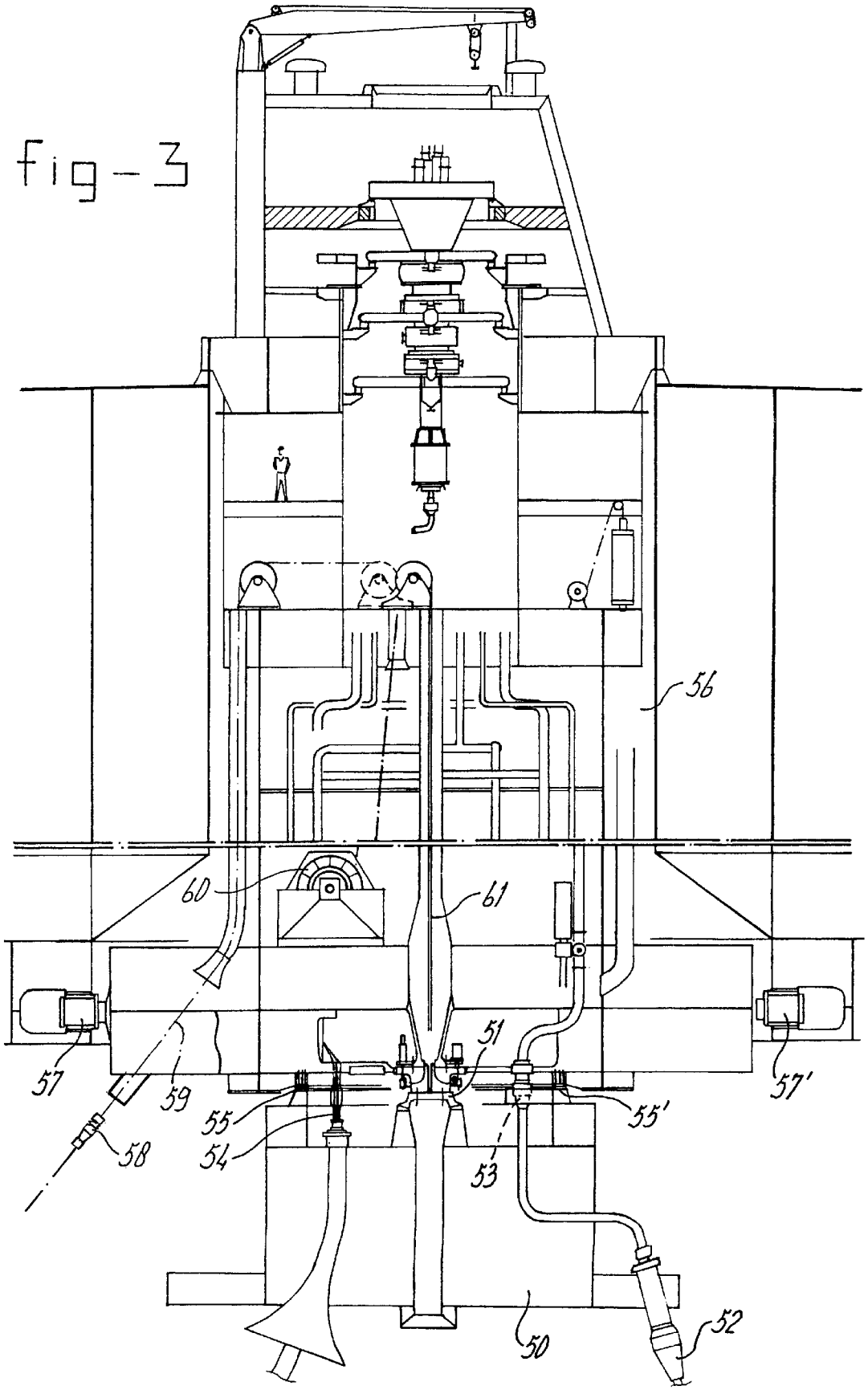
FIG. 3 shows another embodiment of a disconnectable buoy.

FIG. 3 shows another embodiment of a buoy 50 that via a coupling device 51 is connected to the turret 56. The buoy 50 is connected to a cable 61 which runs through the turret 56 to a winch 60. A riser 52 for transporting hydrocarbons from the sub sea structure to the vessel, is connected to the buoy 50, and is attached to a conduit on the vessel via a riser coupling 53. Electrical cables from the sub stea structure are attached to the vessel via electrical connector 54. Inflatable seals 55,55' are located around an upper end of the buoy 50 for a water-tight connection between the buoy 50 and the turret 56, such that the space of the connectors 53, 54 and the space in the turret 56 may be pumped dry and can therefore be easily accessible.

The anchor chains 58 are connected to the lower end of the turret near keel level, near radial bearings 57,57' between the vessel and the turret. Hereby the moments exerted on the vessel via the anchor chains remain low, and are taken up by the bearings 57,57'. Each anchor chain 58 is via a cable 59 connected to the winch 60.

Even though the anchor lines shown in the above figures are detachable, the invention also relates to vessels having anchor lines which are permanently attached between the sea floor and the vessel. Furthermore is the invention not limited to weathervaning vessels comprising a turret, but can also be applied to vessels that do not comprise a turret.

We claim:

1. In a vessel comprising a hull, at least one anchor line for attaching the vessel to a sea floor and a riser supporting buoy releasably connected to the vessel near keel level, the vessel further comprising mechanical and fluid coupling means in the vicinity of keel level for engaging with complementary coupling means on the riser supporting buoy for mechanically coupling the riser supporting buoy to the hull of the vessel in a substantially rigid manner and for providing a fluid connection between a riser connected to the buoy and a fluid conduit on the vessel, and a pulling device for connecting to the buoy and for pulling the buoy, from a predetermined height below water level, with the buoy's coupling means into engagement with the coupling means on the vessel; the improvement wherein said at least one anchor line is attached to the vessel outside the area of the riser supporting buoy, the coupling means of said riser supporting buoy being detachable from the coupling means on the vessel while said at least one anchor line remains attached to the vessel and to the sea floor, the riser supporting buoy comprising at least one stabilization line that is free from the sea floor when the buoy is attached to the vessel and that is located at least partly on the sea floor when the buoy is detached from the vessel, the buoy being free from attachment to the sea floor other than by said riser when said at least one stabilization line is free from the sea floor.

2. Vessel according to claim 8, wherein the anchor line is releasably connected to the vessel via disconnect means.

3. Vessel according to claim 2, wherein the disconnect means comprise for each anchor line a first part attached to the vessel and a second part attached to the respective anchor line, the first part of the disconnect means being directly attached to the vessel near keel level.

4. Vessel according to claim 1, wherein the stabilization line on one end comprises a ballast weight.

5. Vessel according to claim 1, comprising means for ballasting the buoy.

6. Vessel according to claim 1, the vessel comprising a rotatable turret placed in a turret well, the riser supporting buoy and the anchor lines being attached to the turret near keel level.

* * * * *